US005468185A

United States Patent [19]

Truitt

[11] Patent Number: 5,468,185

[45] **Date of Patent: * Nov. 21, 1995**

[54] AIR DISTRIBUTION SYSTEM

[76] Inventor: Archie A. Truitt, 119 - 33 Street West, Saskatoon, Saskatchewan S7L 0T9, Canada

[ * ] Notice: The portion of the term of this patent subsequent to Jan. 11, 2011, has been disclaimed.

[21] Appl. No.: 246,457

[22] Filed: May 20, 1994

Related U.S. Application Data

[63] Continuation-in-part of Ser. No. 115,630, Sep. 3, 1993, abandoned, which is a continuation-in-part of Ser. No. 921,145, Jul. 29, 1992, Pat. No. 5,277,657.

[51] Int. Cl.[6] ..... E06B 7/08

[52] U.S. Cl. ..... 454/198

[58] Field of Search ..... 239/553.5; 454/73, 454/78, 85, 93, 124, 127, 188, 191, 193, 198, 211, 214, 219, 222

[56] References Cited

U.S. PATENT DOCUMENTS

| | | | |
|---|---|---|---|
| 408,235 | 8/1889 | Haskell | 239/553.5 |
| 587,373 | 8/1897 | Parker et al. | 454/198 |
| 791,924 | 6/1905 | Magee | 454/198 |
| 1,717,904 | 6/1929 | Abernethy | 454/93 |
| 2,799,902 | 7/1957 | Muller | 454/127 |
| 3,729,735 | 4/1973 | Dageford | 236/1 R |
| 3,744,724 | 7/1973 | Caille | 454/198 X |
| 4,537,116 | 8/1985 | Nassof | 454/188 |

FOREIGN PATENT DOCUMENTS

| | | | |
|---|---|---|---|
| 883523 | 7/1953 | Germany | 454/198 |

*Primary Examiner*—Harold Joyce
*Attorney, Agent, or Firm*—Bereskin & Parr

[57] ABSTRACT

An air distribution system for directing air over an inner surface of a window includes an air distribution outlet including an elongate air duct and a distribution divider for dividing the duct longitudinally to define inlet and outlet portions. The inlet portion has an inlet port at one end of the duct for communication with an air supply source. The divider defines a longitudinal communicating passage for air communication between the inlet and outlet portions, the passage increasing in cross-section with increasing distance from the one end of the duct and the inlet port. The outlet portion has an outlet port extending longitudinally along one side of the duct. The duct is located in the sill of a window such that air may be directed for an air supply source to the inlet port, through the duct, and over the surface of the window.

25 Claims, 16 Drawing Sheets

AIR DISTRIBUTION SYSTEM

CROSS REFERENCE TO RELATED APPLICATION

This application is a continuation-in-part of U.S. application Ser. No. 08/115,630 filed on Sep. 3, 1993 abandoned, which is a continuation-in-part of U.S. application Ser. No. 07/921,145 filed Jul. 29, 1992 U.S. Pat. No. 5,277,657.

FIELD OF THE INVENTION

This invention relates to an air distribution system and in particular to an air distribution system for providing air flow over an inner surface of a window.

BACKGROUND OF THE INVENTION

The problem of condensation collecting on exterior windows is widely recognized and is present in many buildings, particularly in cold weather, as well as in automobiles, buses, aircraft and the like. The condensation can be unsightly and reduces the natural light available in a building. In moving vehicles, condensation obscures the driver's line of sight, causing dangerous driving conditions. Also, the condensation may collect at the base of windows, and the resulting dampness problems may cause damage to the building structure and fittings, and encourage the growth of fungi and the like, which can lead to respiratory problems in many individuals.

An early proposal for a ventilator which provides one means for alleviating this problem is disclosed in U.S. Pat. No. 1,308,236 to Glass. The patent discloses a sill which permits air flow from the building exterior through a passage and over the internal surface of a window. The inner end of the passage is provided with a shutter which may be opened or closed as desired, and when open directs the incoming air toward the inner side of the window frame. A conduit is located in the passage and may be used to either heat or cool the air at it passes through the sill.

A further early window ventilator is disclosed in U.S. Pat. No. 1,553,507 to Campbell. Like Glass, Campbell discloses a passage through a sill from the building exterior, which can be opened or closed by means of a suitable shutter. However, in Campbell, a hollow metal frame is provided around the window, the sides of the frame accommodating heating pipes or radiators. Various vents are provided in the frame to allow air to flow from the room, past the heating pipes and back into the room.

In U.S. Pat. No. 2,606,074 to Ackerman, an air distribution nozzle is disclosed which is adapted for use in directing a stream of air over a window, to keep the window free of condensation. The nozzle is intended for location at the center of a lower edge of the window and directs air from a single source in an 180° arc through use of radially extending ducts defined by a plurality of internal triangular divisions.

Whereas the earlier patents to Glass and Campbell disclose heating means located in the window frame itself, a number of later patents disclose systems in which heated air is supplied from a remote source, relayed through communicating ducts, and passed through a sill or duct assembly extending along the base of a window. U.S. Pat. No. 2,446,356 to Van Alsburg discloses a system of this type in which an air outlet with an elongate inlet leads into a hollow, sheet metal housing provided with air outlet openings on an upper surface, and an elongate slot in a lower surface. The air passing upwardly through the outlet openings in the upper surface is intended to mingle with the air closest to the window glass, and the air passing through the slot is intended for intermingling with air farther away from the window.

In German Patentschrift No. 883,529, to Jutzi, a hollow sill having apertures in an upper surface is disclosed, warm air being supplied from a blower and burner to the sill, to pass up and over an inner surface of a window.

In U.S. Pat. No. 3,439,601 to Cooper a forced air circulating system is disclosed, in which air is supplied from a fan or pump unit through horizontal ducts. The air passes from the ducts into a larger volume air cavity which reduces the pressure of the air. The air flows upwardly through the cavity to a hollow sill member and exits through slots in the sill member. The dimensions of the slots are considerably smaller than the interior of the sill member to produce an increase in velocity of the air as it passes through the slots such that the air is forced upwards to travel along the inside surface of a window.

SUMMARY OF THE INVENTION

In accordance with the present invention there is provided an air distribution outlet comprising:

an elongate air duct;

a distribution divider for dividing the duct longitudinally to define inlet and outlet portions;

the duct defining an inlet port at one end of the inlet portion for communication with an air source and an outlet port in the outlet portion extending longitudinally of the duct;

the distribution divider defining a communication passage extending longitudinally of the duct for air communication between the inlet and the outlet portions, the passage increasing in width with increasing distance from said inlet port; and a plurality of fins located on the distribution divider and extending into the inlet portion, the fins increasing in length with increasing distance from the inlet port;

whereby air entering the inlet port is distributed by the distribution divider substantially evenly to the outlet port.

BRIEF DESCRIPTION OF THE DRAWINGS

This and other aspects of the present invention will now be described, by way of example, with reference to the accompanying drawings, in which.

DETAILED DESCRIPTION OF PREFERRED EMBODIMENTS

Figure 1:
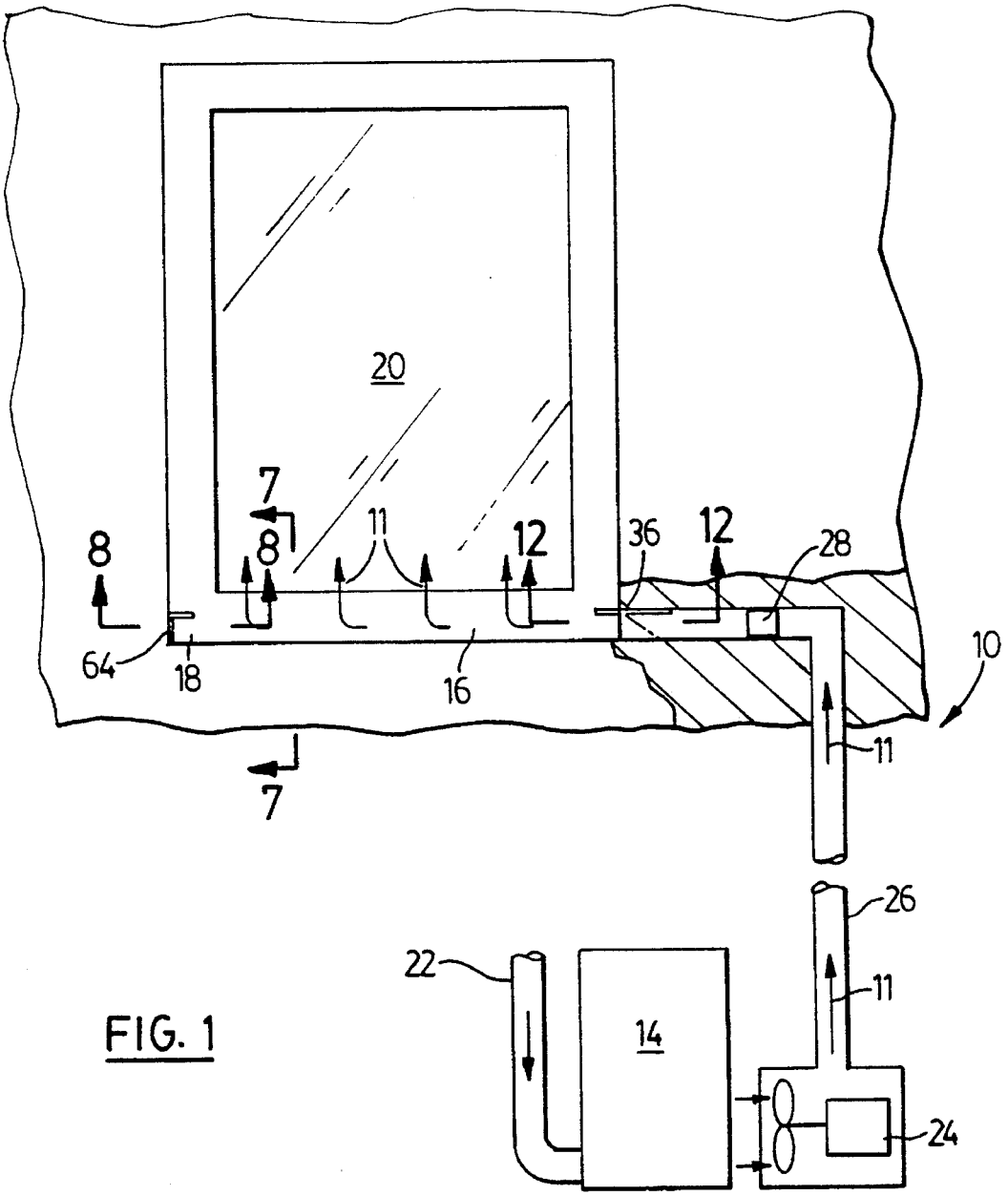
FIG. 1 is a simplified view of an air distribution system in accordance with the present invention.

Reference is made first to FIG. 1 of the drawings which illustrates an air distribution system, generally indicated by the numeral 10, in which heated air, indicated by arrows 11 is supplied from a forced air furnace 14 to an air duct 16 located in the sash or sill 18 of a window 20 to keep the inside surface of the window free from condensation.

Figure 2:
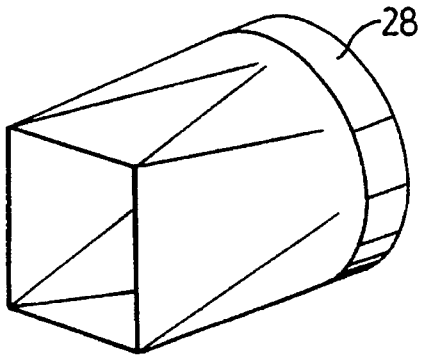
FIG. 2 is a perspective view of a round to rectangular connector for use in the distribution system of FIG. 1.

The furnace 14 is merely exemplary of a warm air supply, and includes a conventional cold air return 22 and a multi-blade, variable speed fan 24, which draws the heated air from the furnace 14 and pushes it through a suitable duct system. For simplicity, only a single duct 26 is illustrated and in the preferred embodiment, the duct 26 is formed of conventional, cylindrical, galvanized steel lengths. The ducting extends to adjacent the lower side of the window 20, where a round to rectangular coupling 28 is provided and which leads into the rectangular air duct 16, which is located in the lower sash or sill 18 of the window. The round-to-rectangular coupling 28 is illustrated in more detail in FIG. 2 of the drawings. As will be described below, the duct 16 is arranged such that the heated air is evenly distributed over the width of the window and rises over the inner surface of the window to maintain the surface condensation free.

Figure 3:
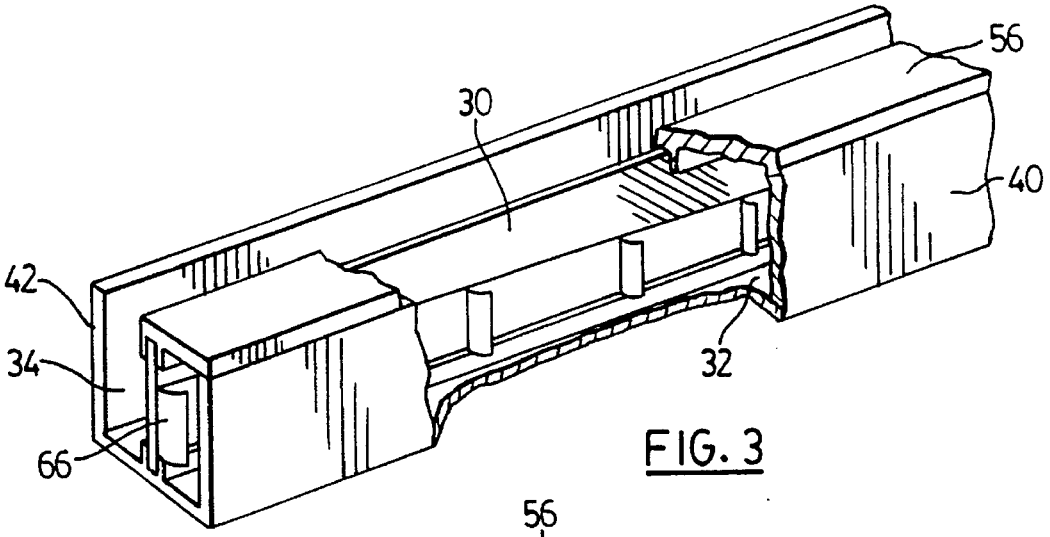
FIG. 3 is a partly cut away perspective view of an air duct forming part of the air distribution system of FIG. 1.
Figure 4:
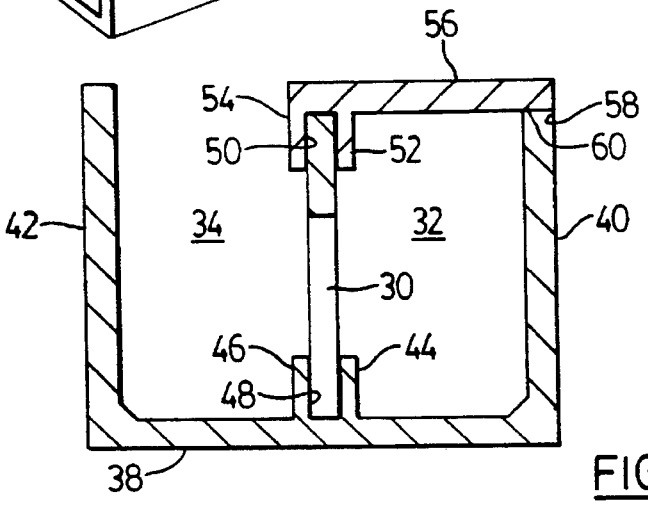
FIG. 4 is an enlarged sectional view of the air duct of FIG. 3.
Figure 5:
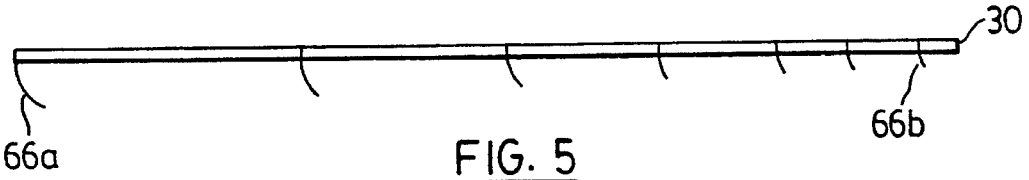
FIG. 5 is a plan view of a distribution divider forming part of the air duct of FIG. 3.
Figure 6:
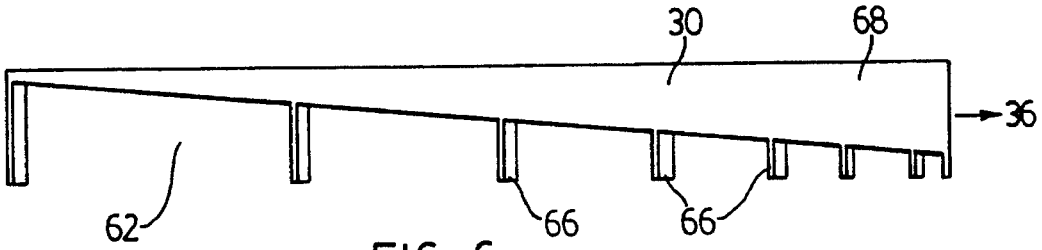
FIG. 6 is an elevation of the distribution divider of FIG. 3.

Reference is now also made to FIGS. 3, 4, 5 and 6 of the drawing, FIG. 3 showing a partly cut away portion of air duct, FIG. 4 illustrating the air duct 16 in section, and FIGS. 5 and 6 illustrating a distribution divider 30 which is located within the duct 16 and divides the duct 16 longitudinally to define inlet and outlet portions 32, 34. The inlet portion 32 is formed on the right hand side of the duct, as shown in FIG. 4, and is in direct communication, via an inlet port 36 (FIG. 1), with the rectangular portion of the air duct 26. It will be noted from FIG. 1 that the inlet port 36 is located at one side of the window 20.

The duct 16 has a base 38 and upstanding sides 40, 42 and extending longitudinally along the center of the base 38 are two ribs 44, 46 which define a longitudinal slot 48. Opposing the slot 48 is a second slot 50 formed by two ribs 52, 54 which extend along the edge of a vent cap 56 which extends from the duct side 42, and encloses the top of the inlet portion 32. The edge of the vent cap 56 is provided with a longitudinal bead 58 for location in a complementary recess 60 in the upper end of the side 42. The slots 48, 50 serve to locate a distribution divider 30 which, if reference is made to FIGS. 3 and 6, may be seen to define a tapered opening 62, the divider 30 being located in the duct 16 with the opening 62 increasing in width or cross-section (i.e. the clearance created by the opening) from a minimum adjacent the inlet port 36, to a maximum at the opposite end of the duct, which is closed by an end cap 64 (FIG. 1). The opening 62 is provided at the base of the divider 30 and is punctuated by upright fins 66 extending downwardly from a triangular portion 68, the spacing between the fins increasing with the increasing width or cross-section of the opening 62. In the particular example illustrated, where the divider 30 is two feet long, the fins are spaced by 1", 2", 3", 4", 5" and 7". Also, the fins 66 extend into the inlet portion 32 and, as may be seen in FIG. 3 and 5, the fins 66 extend further into the inlet portion 32 with increasing distance from the inlet port 36. The fins have a length in a direction perpendicular to the plane of the opening 62. In this particular example the distribution divider 30 is formed of 1/16" sheet and the longest fin **66*a* extends ½" into the inlet portion 32 while the first fin 66*b*, extends ¼" into the inlet portion 32**.

By providing the arrangement of fins and a tapered opening as described above, the air entering the one end of the duct at the inlet port 36 is distributed evenly from the inlet portion 32 into the open topped outlet portion 34, from where the warm air passes up over the inside surface of the window 20.

As windows come in a great variety of forms, the mounting of the air duct 26 and the link between the air supply duct 26 and the duct 16 will vary according to the particular application. By way of example, there follows descriptions of windows of various forms provided with an air distribution system, as broadly described above.

Figure 7:
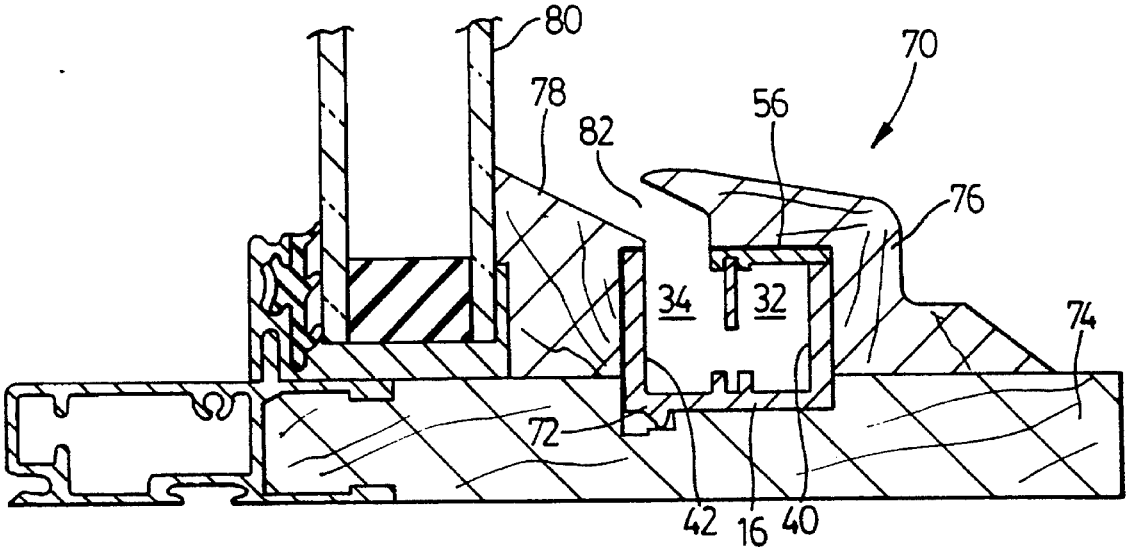
FIG. 7 is a sectional view corresponding in located to line 7—7 of FIG. 1, where the window of FIG. 1 is fixed.

Reference is first made to FIG. 7 of the drawings which illustrates an air duct 16 located in a fixed unit, generally indicated at 70. The duct 16 sits in a groove 72 provided in the window sill 74 and is located between two wooden straps 76, 78. The strap 78 adjacent the window pane extends over the top of the side 42 of the duct and slopes upwardly to the inside face of the inner pane 80. The other strap 76 rests on the sill 74 and extends over the side 40 and vent cap 56, and then extends upwardly and towards the pane 80 to define an air passage 82 for the air leaving the outlet portion 34.

Figure 8:
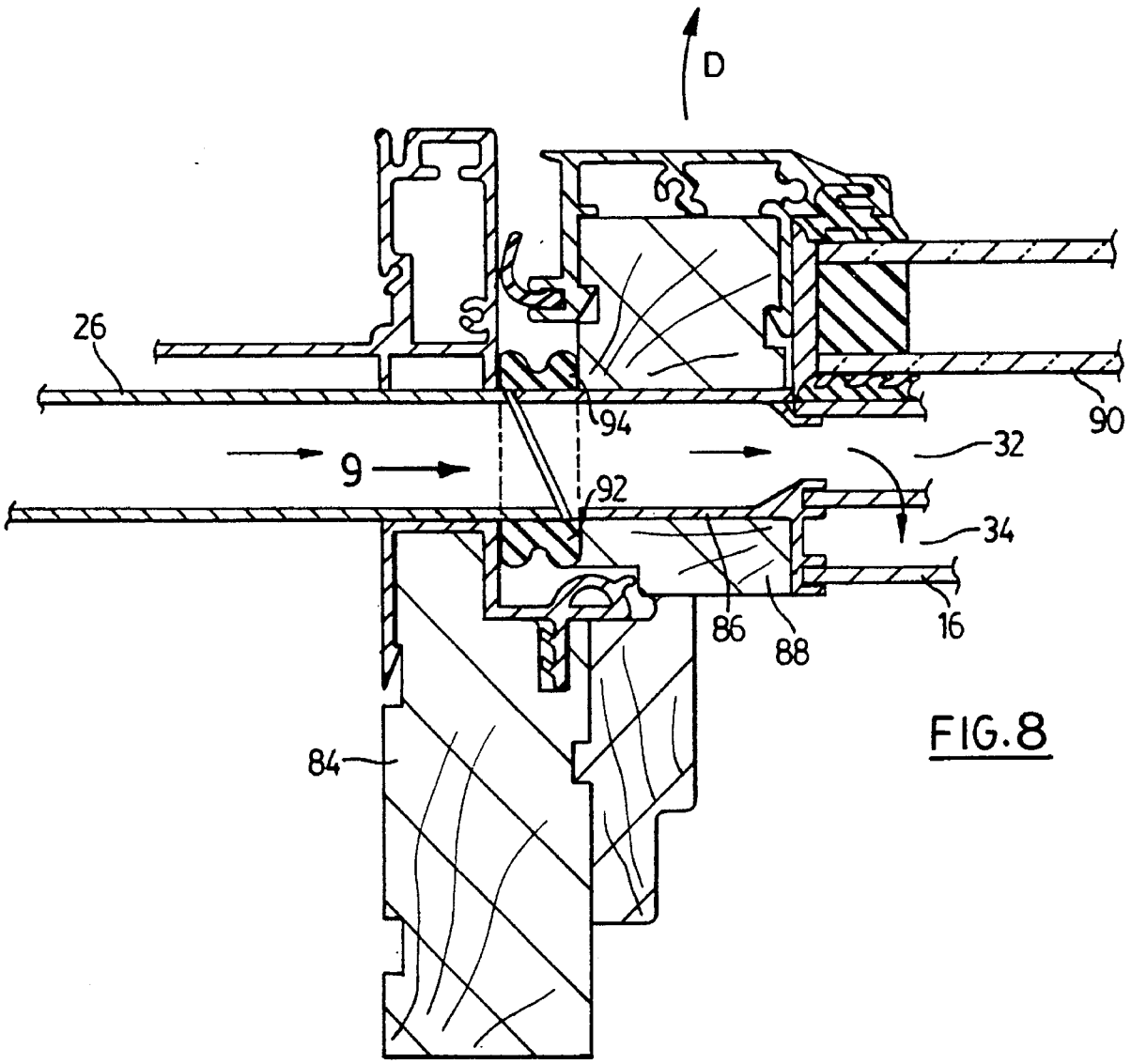
FIG. 8 is a sectional view corresponding to line 8—8 of FIG. 1, where the window of FIG. 1 is openable by pivoting about line a—a, and where the inlet to the air ducts is located to the left hand side of the window (as shown in ghost outline)

Reference is now made to FIG. 8 of the drawings, which illustrates a section of a window and frame, where the window is pivotal about an upright axis and is opened by moving the side of the window in direction D. The air duct 26 can be seen extending from the left of the Figure through the jamb 84, into a short duct 86 extending through the window side sash 88 and into the inlet portion 32 of the duct 16. The arrangement differs somewhat from that described in FIG. 7 above, in that the outlet portion 34 of the duct 26 is located further from the window pane 90 than the inlet portion 32. The intersection between the duct 26 and the duct 86 is located in a space between the jamb 84 and the sash 88, the ends of the ducts 26, 86 being cut as an oblique angle to permit opening of the window. A resilient seal 92 is mounted on the inside of the gap on the end of the duct 16, while a further seal 94 is mounted on the outer side of the gap on the end of the duct 86.

Figure 9:
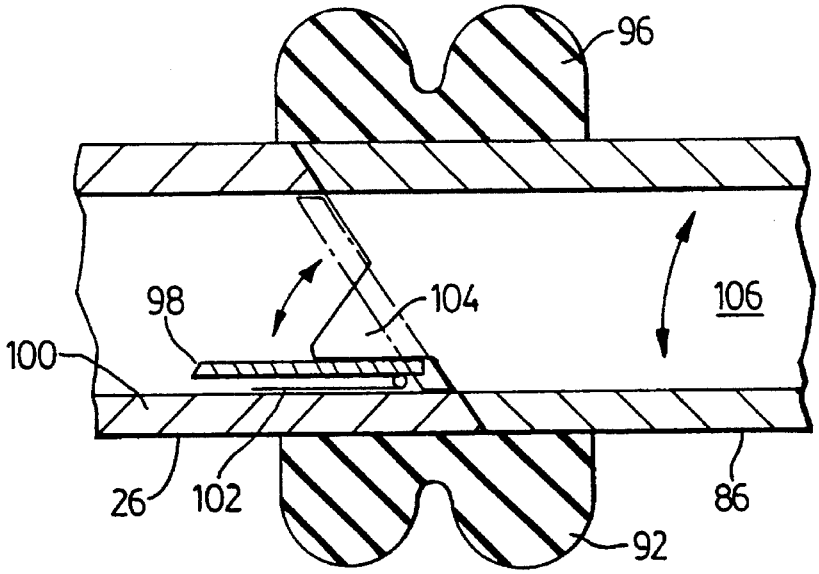
FIG. 9 illustrates a valve arrangement provided in area 9 of FIG. 8 (on same sheet as FIG. 6)

When the window is opened, it is desirable that the duct 26 is closed, such that the heated air from the furnace does not continue to flow through the open end of the duct. To close the duct 26, a valve arrangement is provided, and this is shown in more detail in FIG. 9 of the drawings (on same sheet as FIG. 7). Mounted on the end of the duct 26 is a pedal valve 96 in the form of a rectangular closure member 98 mounted on a sidewall 100 of the duct via a spring 102 which tends to push the closure member 98 from a position parallel and adjacent to the sidewall 100 to the position shown in ghost outline in FIG. 9, in which the member 98 extends across the duct and closes the end of the duct. FIG. 9 illustrates the closure member 98 in the open configuration, the member 98 being held open by a raised extension 104 which extends from the base 106 of the duct end 86. When the window is closed, the end of the triangular extension 104 bears against the outer face of the closure member 98 and pushes it into the open configuration.

Figure 10:
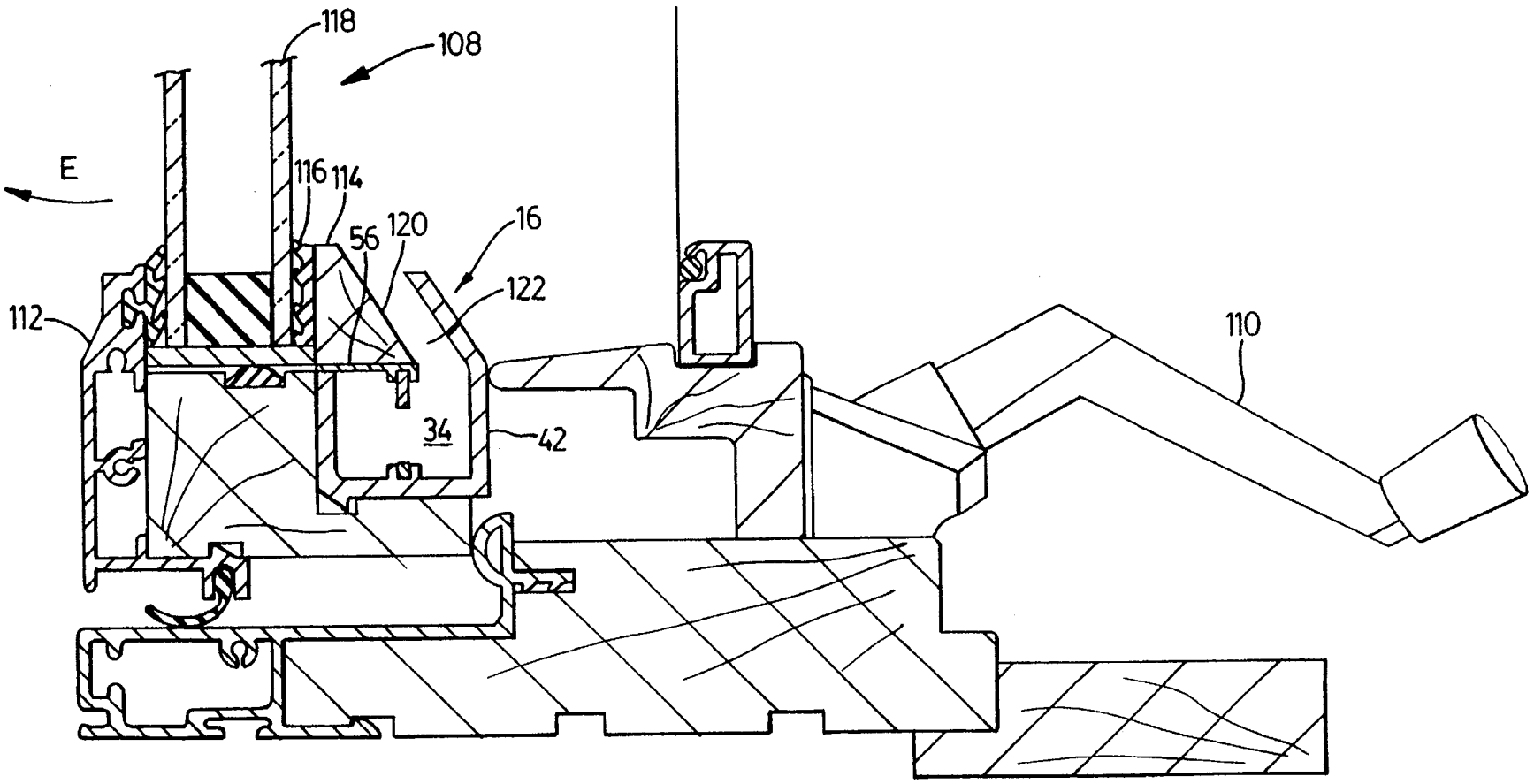
FIG. 10 is a sectional view corresponding to line 7—7 of FIG. 1 where the window is of the casement and awning type.

Reference is now made to FIG. 10 of the drawings, which illustrates a window 108 which is moveable about a horizontal axis. In this particular example the window being opened by rotation of a arm 110 to move in direction E.

The duct 16 is located in the window sash 112, a wedge shaped strap 114 being located over the vent cap 56 and adjacent the sealing edge 116 at the base of the inner pane 118. In this particular embodiment the side 42 of the duct 16 is extended and runs parallel to a face 120 of the strap 114 to define a passage 122 leading from the outlet portion 34 to the base of the inner pane.

Figure 11:
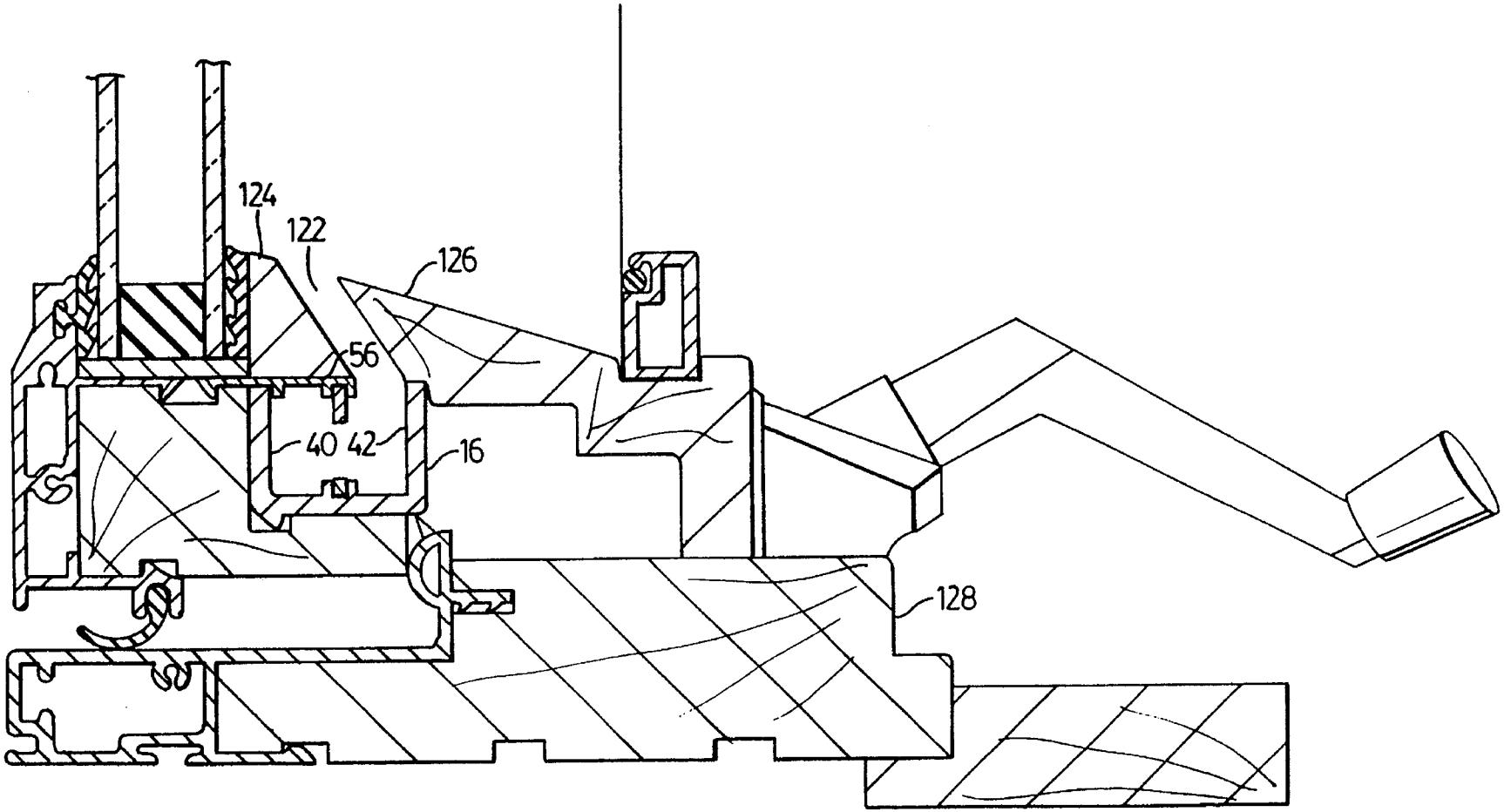
FIG. 11 corresponds to a sectional view of line 7—7 of FIG. 1, where the window is of the casement type.

FIG. 11 illustrates a somewhat similar arrangement, but in which the duct 16 is provided with sides 40, 42 of similar height, the passage 122 from the duct 16 to the base of the window being defined by a strap 124 mounted above the vent cap 56 and a fixed sill portion 126 located on the window sill 128.

Figure 12:
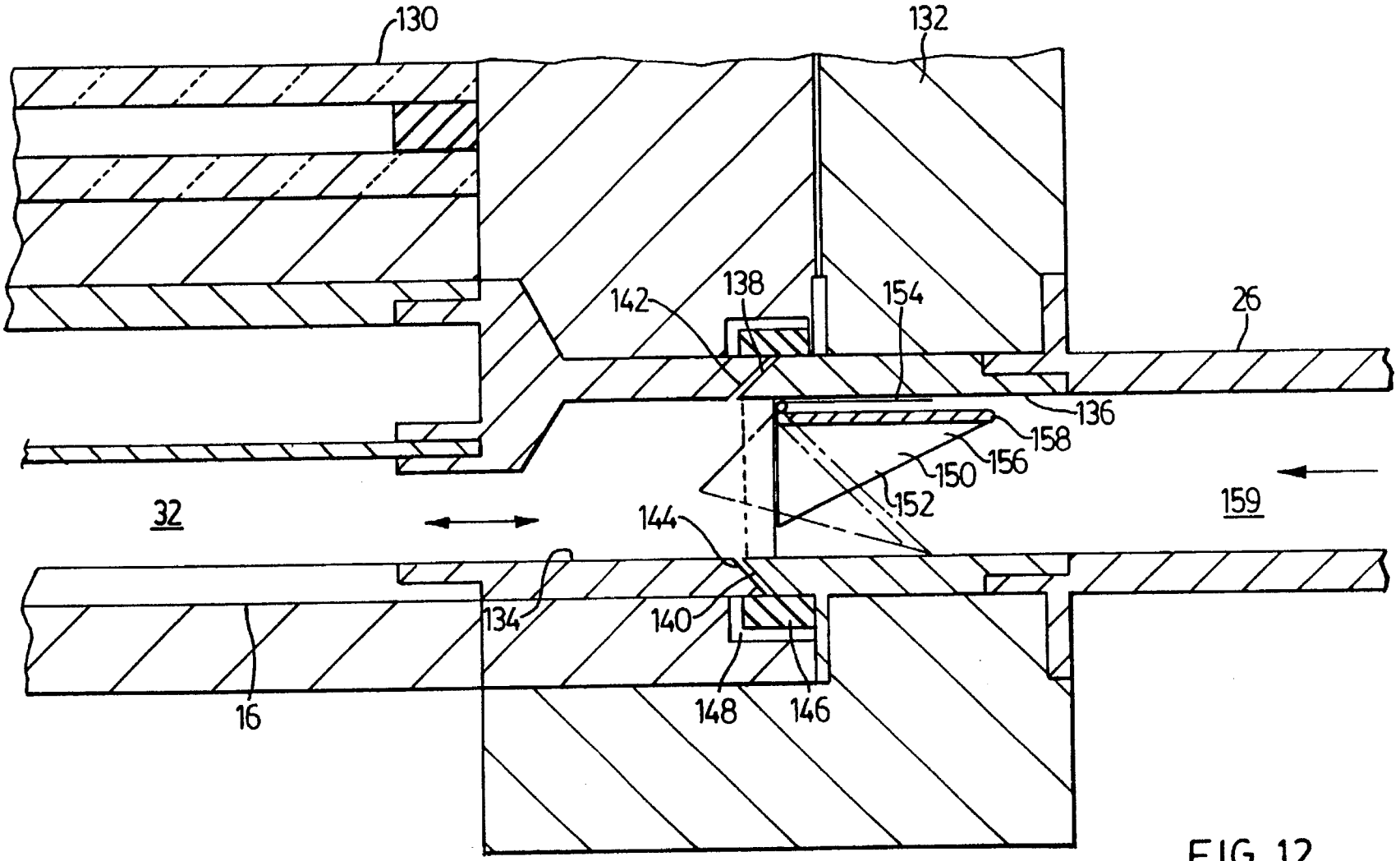
FIG. 12 corresponds to a sectional view on line 12—12 of FIG. 1, where the window is of the sliding type.
Figure 16:
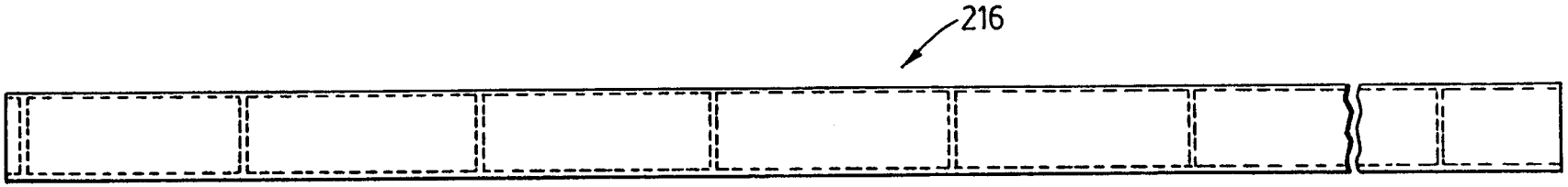
FIG. 16 is a side view of the air duct of FIG. 13.

Reference is next made to FIG. 12 of the drawings, which illustrates an edge portion of a sliding window 130 and an associated jamb 132. The end of the duct 26 may be seen extending from the right hand side of the figure and communicates with a short duct 134 which communicates with the inlet portion 32 of a duct 16. The figure is primarily intended to illustrate the means for closing the ends of the duct 26 when the window 130 is opened. It will be noted that the duct 26 includes a short extension 136 having tapered wall ends 138, 140 arranged to be received within the flared wall ends 142, 144 of the duct 134 leading to the distributing duct 16. A resilient sealing member 146 is mounted in a channel 148 which extends around the end of the duct 134. The sealing member 146 extends beyond the end of the duct 134, such that when the window is closed, the sealing member 146 covers the small space between the ends of the ducts 134, 136.

To permit sealing of the duct 26 when the window is open, a pedal valve 150 is provided in the duct extension 136 and comprises a triangular closure member 152 mounted on the sidewall of the duct through a spring 154. The closure member 152 comprises a triangular base 156 and a rectangular, upright portion 158 which lies parallel and adjacent to the duct wall when the valve 150 is in the open configuration. The base 156 lies parallel to an adjacent lower wall 159 of the duct extension and, in the open configuration, the end of the base 156 abuts an end portion of the base of the short duct 134. Thus, when the window is opened the spring rotates the closure member such that the upright portion 158 extends across and seals the duct extension 136, and the duct 26.

Thus, it will be apparent that the present invention provides a simple yet effective air distribution system.

With reference to FIGS. 13–23, a preferred embodiment of the present invention is shown which is particularly suitable for windows in automobiles, buses, aircraft and the like. The reference numerals used in FIGS. 13–23 are similar to those used for the components of the system 10 of FIGS. 1–6, but are preceded with the prefix "2". For brevity, the description of similar components is not repeated, and with allowance for modifications, the earlier description applies to these Figures. A difference between the earlier discussed system 10 and the air distribution system of FIG. 13–23 is the location of the inlet port 236 on the left side of the air duct 216 rather than on the right side as in the earlier illustrations. Hence, heated air moves through the inlet portion 232 generally from left to right.

Referring specifically to FIGS. 13–17, the air duct 216 has upstanding sides 240, 242. The upper ends of the sides 240,242 have recess portions or seats 260,261, respectively, for receiving complementary slots 258, 259 in a vent cap 256. In this embodiment, the vent cap 256 is joined with, and forms part of, the distribution divider 230. Hence, the distribution divider is located and supported in the duct 216 by the upper ends of the sides 240, 242, doing away with the ribs 44, 46 (see FIG. 4).

Figure 14:
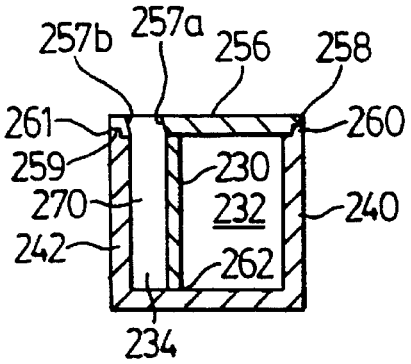
FIG. 14 is a view along line 14—14 of FIG. 13.
Figure 17:
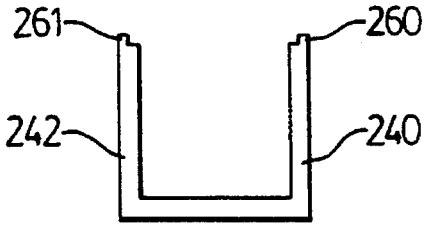
FIG. 17 is an end view of the air duct of FIG. 16.
Figure 19:
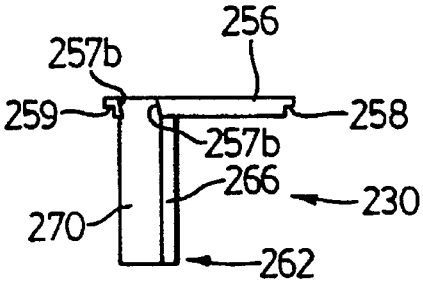
FIG. 19 is an end view of the distribution divider of FIG. 18.
Figure 18:
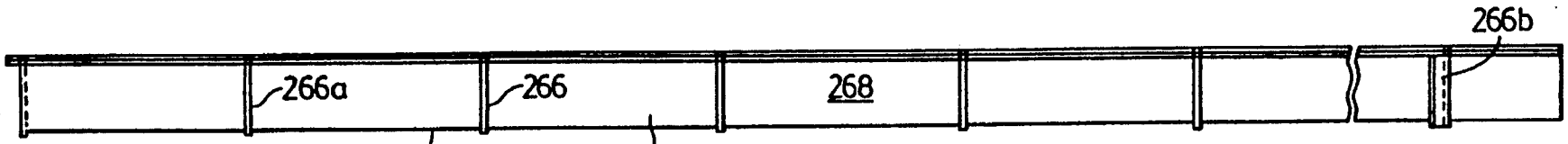
FIG. 18 is an elevated side view of the distribution divider of FIG. 13.
Figure 20:
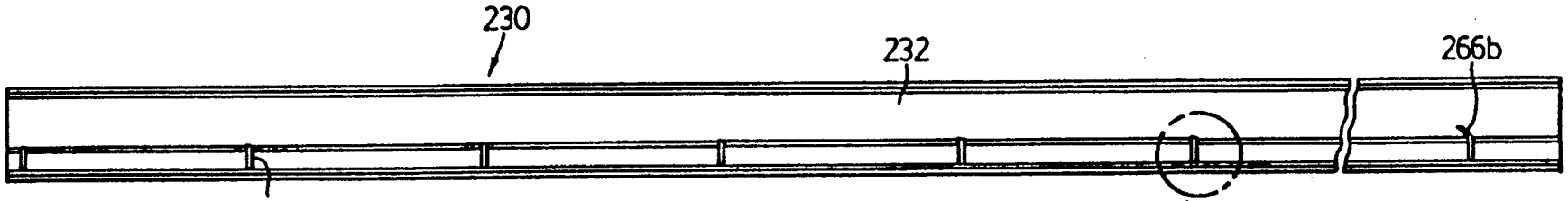
FIG. 20 is a bottom view of the distribution divider of FIG. 18.
Figure 21:
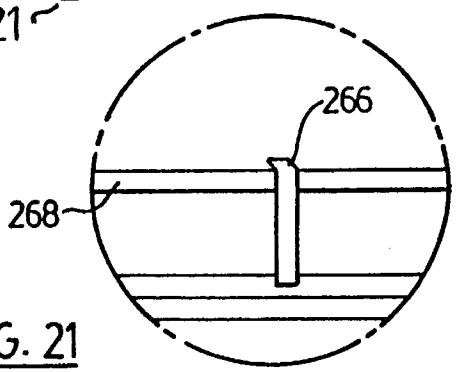
FIG. 21 is a close-up bottom view of a fin of the distribution divider of FIG. 20.

As in the earlier discussed versions, the distribution divider 230 divides the duct 216 longitudinally to form the inlet portion 232 and an outlet portion 234. Referring to FIG. 14, the inlet portion 232 comprises about ⅔ of the duct's cross-section area, and the remaining ⅓ of the duct's area forms the outlet portion 234. This ratio is maintained regardless of the duct's dimensions or cross-sectional configuration (i.e. whether the duct has a square or other rectangular cross-section). Air exiting the outlet portion 234 is deflected onto the window being defogged by inclined ribs or deflectors **257*a* and 257*b* located on the vent cap 256 portion of the divider 230**. In this embodiment, the deflectors are inclined about 15° away from the vertical as shown.

Referring to FIGS. 18–21, the divider 230 has a tapered opening 262 at its base punctuated by upright fins 266 which extend downwardly from a wall portion 268. As in the earlier embodiments, the tapered opening 262 is smallest adjacent the inlet port 236 and gradually increases to a maximum at the opposite end of the duct 216, which is closed by an end cap 264. For example, in a divider 230 having a length "LD" of 26.5 inches (675 mm) (see FIG. 18), good results have been obtained with a minimum opening "MIN.0" of 0.02 in. (0.50 mm) to a maximum opening "MAX.0" of 0.03 in. (0.75 mm). However, even better results have been obtained in a preferred embodiment with a MIN.0 of 0.03 in. (0.75 mm) and a MAX.0 of 0.11 in. (2.75 mm). The larger opening 262 has been found to reduce noise levels while allowing larger volumes of air to pass through. The larger opening also allows for higher air pressures and helps prevent the formation of slip patterns in the air exiting the outlet 234.

It is noted that, unlike the earlier embodiments, the clearance of the opening 262 does not increase to almost the height of the inlet and outlet portions 232, 234. Instead, the clearance of the opening preferably should not exceed about 50% of the height of the duct 276. This ensures that the opening 262 is a principal element in throttling, controlling and distributing the flow, to ensure uniform flow over a window.

The dimensions of the opening 262 will change depending on the dimensions or size of the air duct 216. In the latter example noted above where the divider has a MIN.0 of 0.03 in., the air duct 216 has a 0.4×0.4 in. (10 ×10 mm) size, namely a height of 0.4 in. (10 mm) (i.e. The height of the sides 240, 242 shown in FIG. 14) and a width of 0.4 in. (10 mm) (i.e. The perpendicular distance between the outside surfaces of the sides 240, 242). For every 0.4 in. (10 mm) change in duct size, the clearance of the opening 262 should be changed by about 10%. "Duct size" in this instance refers to the height, or width, or both height and width of the duct as viewed in FIG. 14. For example, if the width of the duct doubles from 0.4 in. to 0.8 in. (20 mm) and the height remains unchanged, then the clearance of the opening 262 should be increased by about 10%, namely MIN.0 would increase by 0.003 in. (0.075 mm) to 0.033 (0.825 mm) and the MAX.0 would increase by 0.01 in. (0.275 mm) to 0.12 in. (3.025 mm). Likewise, should the width of the duct be tripled to 1.2 in. (30 mm), the clearance should be increased by about 20%, namely to a MIN.0 of 0.035 in. (0.90 mm) and a MAX.0 of 0.13 in. (3.30 mm). The upper limit of the opening 262 would be achieved with a duct size of 0.4 in.×4.0 in. (10×100 mm), wherein the MIN.0 is 0.06 in. (1.425 mm) and the MAX.0 is 0.21 in. (5.225 mm), since MAX.0 has reached about 50% of the height of the duct. If the duct's width is increased beyond the 0.4×4.0 in. (10×100 mm) size, there is no marked benefit in further increasing the clearance of the opening 262. If the size (i.e. height) of this duct were increased to 0.8×4.0 in. (20×100 mm), it will be appreciated that new room would be created for further increases in the clearance of the opening 262 up to a maximum of about 0.4 in. (10 mm).

It is preferable that the cross-section of the duct remain relatively square to achieve good air flow characteristics. Hence, in an increase in the size of the duct from 0.4×0.4 in (10×10 mm) to 0.8×0.8 in (20×20 mm), the clearance of the opening 262 should be increased by about 10%. Likewise a 1.2×1.2 in (30×30 mm) duct should have a 20% greater clearance than the 0.4×0.4 in. (10×10 mm) duct.

In this embodiment, the spacing of the fins is constant. In an air duct having a 0.4×0.4 in. (10×10 mm) size, good results have been achieved using a fin spacing of 1 in. (25 mm). The spacing may be changed by 10% for every 0.4 in. (10 mm) change in the duct size (as defined above). For example, an increase in duct size from 0.4×0.4 in. (10×10 mm) to 0.8×0.8 in. (20×20 mm) would result in an increase in fin spacing to 1.1 in. (27.5 mm), and a 1.2×1.2 in (30×30 mm) duct would have a spacing of 1.2 in. (30 mm). Similarly, merely increasing the duct's width from 0.4 in. (10 mm) to 0.8 in. (20 mm) would lead to a 10% increase in fin spacing from 1 in. (25 mm) to 1.1 in. (27.5 mm). For a duct size of 3.9×3.9 in. (100×100 mm), the fin spacing would be 1.9 in. (47.5 mm).

The length of each fin (i.e. that portion extending from the divider 230 into the inlet portion 232) increases with increased distance from the inlet port 232. In the embodiment shown, good results have been achieved by increasing the length of each fin (measured perpendicular to the plane of the opening 262 of the divider) by 0.002 in. (0.05 mm), moving from left to right in FIG. 20. Hence, the fin 266*a* has a length of 0.002 in. (0.05 mm), and the fin 266*b* (shown in detail in FIG. 1) has a length of 0.05 in. (1.30 mm) as indicated by the reference letters "LF".

As well, the fins 266 are inclined toward the inlet port 236 to help redirect air from the inlet portion 32 through the opening 262. Good results have been achieved using an angle "A" of about 45° measured from the wall portion 268 of the divider 230. In the embodiment shown, each of the fins 266 are relatively flat or straight along their length. However, the fins may also be concavely curved or bowed toward the inlet port 236 (as shown earlier in FIGS. 3 and 5).

It can also be seen in FIGS. 13 and 18–21 that the fins 266 are integral with dividing walls 270. These walls 270 divide the outlet portion 234 into discrete sections and prevent cross-flow between adjacent sections.

Figure 13:
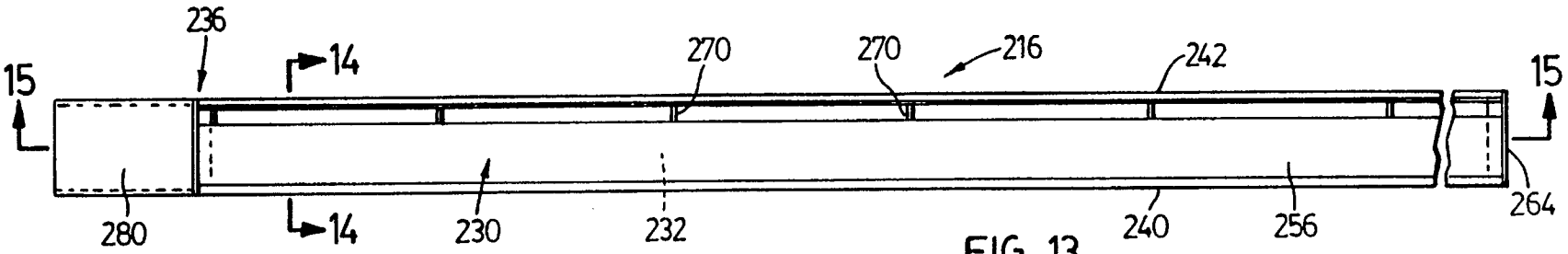
FIG. 13 is a plan view of a preferred embodiment of the distribution divider and air duct, including a coupler connected at one end thereof, according to the present invention.
Figure 15:
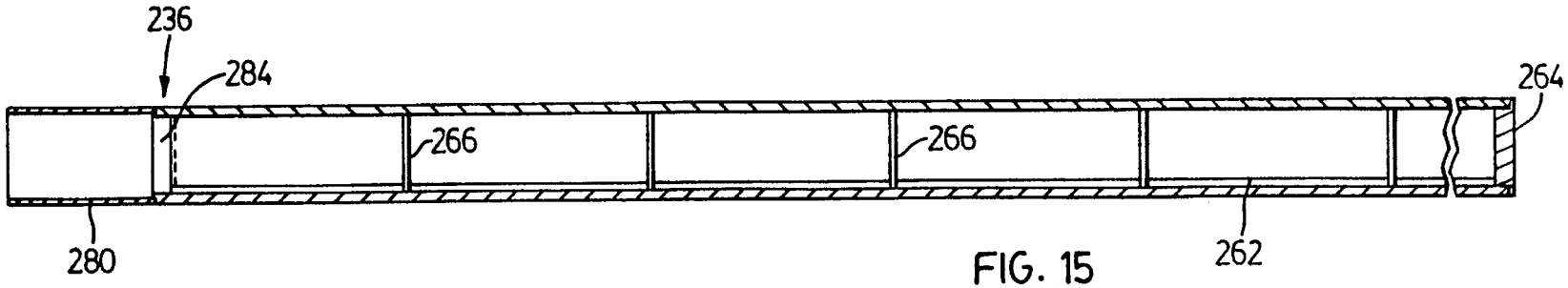
FIG. 15 is a view along line 15—15 of FIG. 13.
Figure 22:
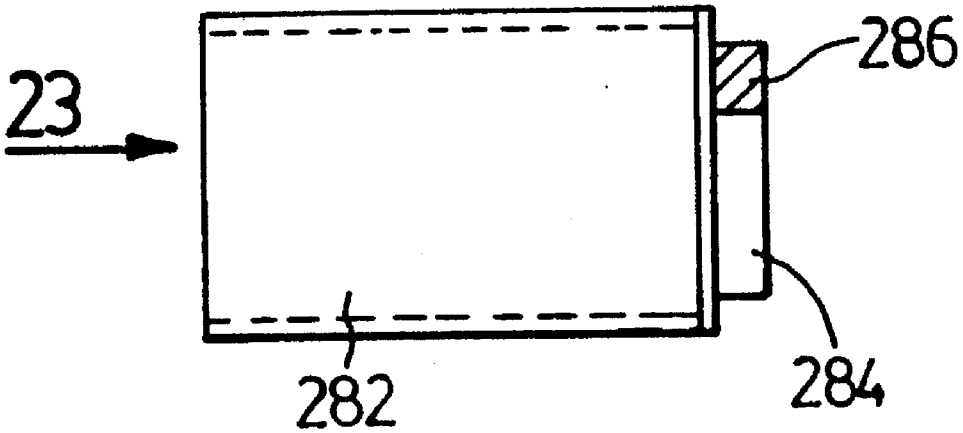
FIG. 22 is a close-up view of the coupler of FIG. 13.
Figure 23:
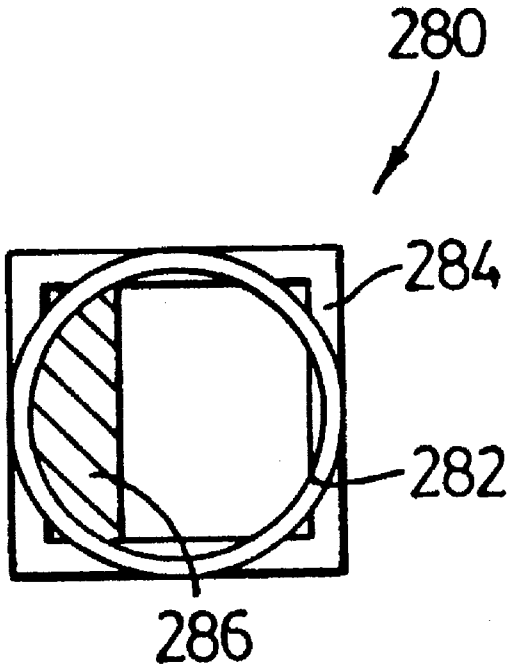
FIG. 23 is an end view of the coupler of FIG. 22 as viewed in the direction of arrow 23.
Figure 24:
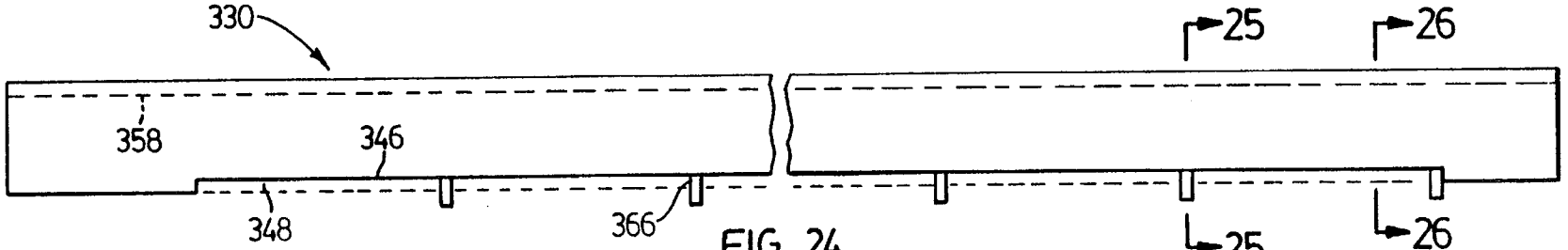
FIG. 24 is a plan view of another preferred embodiment of a distribution divider of the distribution system according to the present invention.
Figure 27:
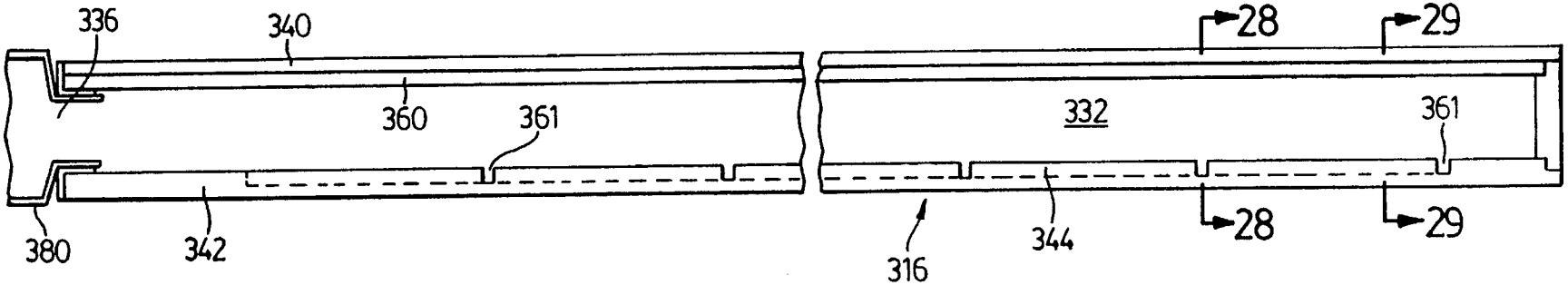
FIG. 27 is a plan view of an air duct of the preferred embodiment of the distribution system of FIG. 24.
Figure 25:
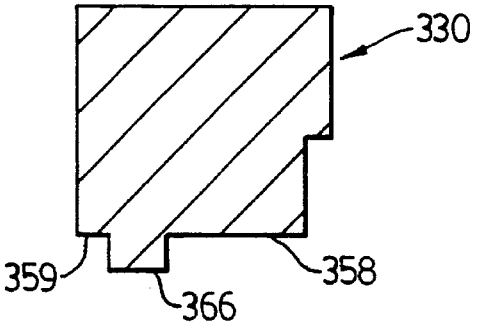
FIG. 25 is a cross-sectional view along line 25—25 of FIG. 24.
Figure 26:
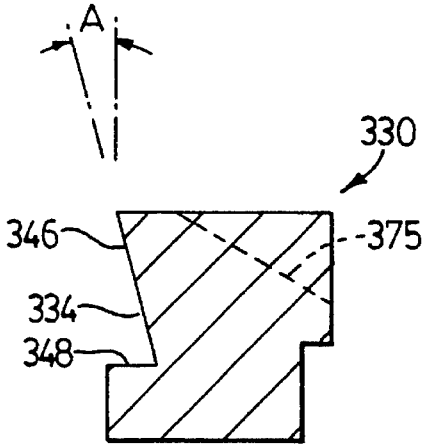
FIG. 26 is a cross-sectional view along line 26—26 of FIG. 24.
Figure 28:
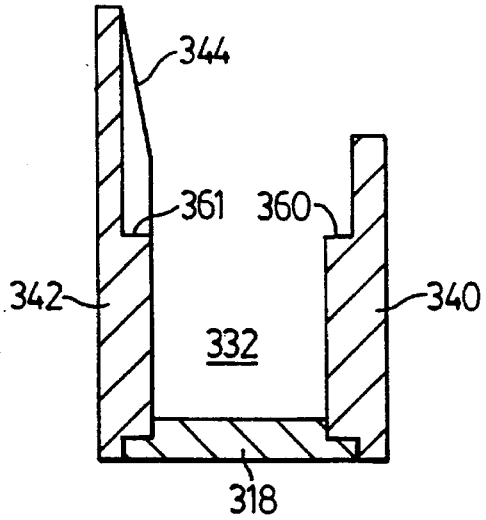
FIG. 28 is a cross-sectional view along line 28—28 of FIG. 27.
Figure 29:
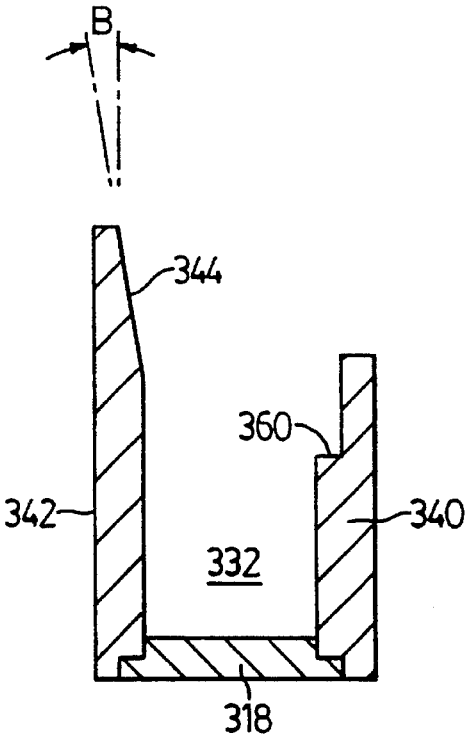
FIG. 29 is a cross-sectional view along line 29—29 of FIG. 27.
Figure 30:
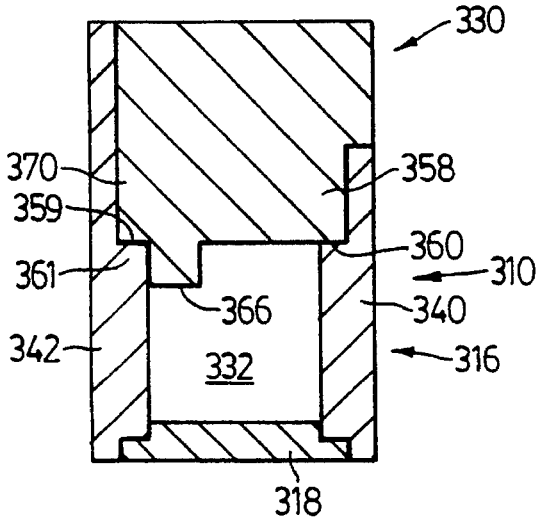
FIG. 30 is a cross-sectional view similar to FIGS. 25 and 28 showing the distribution divider of FIG. 25 inserted into the air duct.

Referring now to FIGS. 22 and 23, as well as to FIGS. 13 and 15, a coupler 280 is shown. A first part 282 of the coupler 280 is shaped to engage the ducts 26 leading from the air source. The ducts in this example happen to be round. A second part 284 is shaped to engage the inlet port 236 of the duct 216, which in this example is square. A portion of the cross-section of part 284 (see the shaded area 286 in FIGS. 22 and 23) must be blocked off so that incoming air only enters the inlet portion 232 of the duct 216. It will be appreciated that the shape of area 286 will change depending on the size of the various components and the location of the divider 230 in the duct 216.

With reference to FIGS. 24–32, another preferred embodiment of the present invention is shown which, like the embodiment shown in FIGS. 13–23, is also particularly suitable for windows in automobiles, buses, aircraft and the like. For ease of reference, reference numerals used in FIGS. 24–32 are similar to those used for the components of the system of FIGS. 13–23, but are preceded with the prefix "3". For brevity, the description of any similar components is not repeated, and with allowance for modifications, the earlier description applies to these Figures. A difference between the earlier discussed systems 10, 210 and the air distribution system 310 of FIGS. 24–32 is the vertical orientation of the tapered opening 362 in the distribution divider 330 rather than a horizontal orientation as in the earlier illustrations. This difference, and its advantages, are discussed below.

The air distribution system 310 has two main components, namely the distribution divider 330 and an air duct 316 with upstanding sides 340, 342. The side 340, has a recessed portion or seat 360, for receiving a complementary seat 358, of the distribution divider 330, and the side 342 has slots 361 for receiving seats 359 of fins 366. The air duct 316 may have a removable floor or base 318 to provide access to the inlet portion 332 of the duct.

As in the other versions of the distribution system, the distribution divider 330 divides the duct 316 longitudinally to form an inlet portion 332 and an outlet portion 334. Air enters the inlet portion 332 through an inlet port 336 and exits the outlet portion 334 through an outlet port 338. Air exiting the outlet portion 334 is deflected onto the window being defogged by inclined sidewalls 344, 346. Sidewall 344, formed by an upper portion of the side 342, is inclined by an angle B from the vertical (see FIG. 29), and sidewall 346 of the distribution divider is inclined by an angle A from the vertical (see FIG. 26). Preferably, angles A and B range between 10° and 20°, and A can be larger than B, to give the taper shown. Good results have been achieved using angles A and B of 12° to ensure that the exiting air hits the windshield as close as possible to the duct (for example, no further than 10 mm from the duct). A wall 348 forming a lower extent of the outer portion 334 may also be inclined (as shown) to facilitate air flow.

Figure 31:
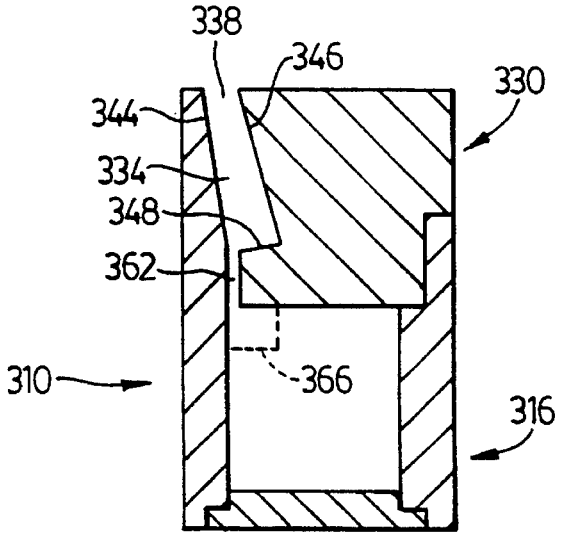
FIG. 31 shows a cross-sectional view similar to FIGS. 26 and 29 showing the distribution divider of FIG. 26 inserted into the air duct.
Figure 32:
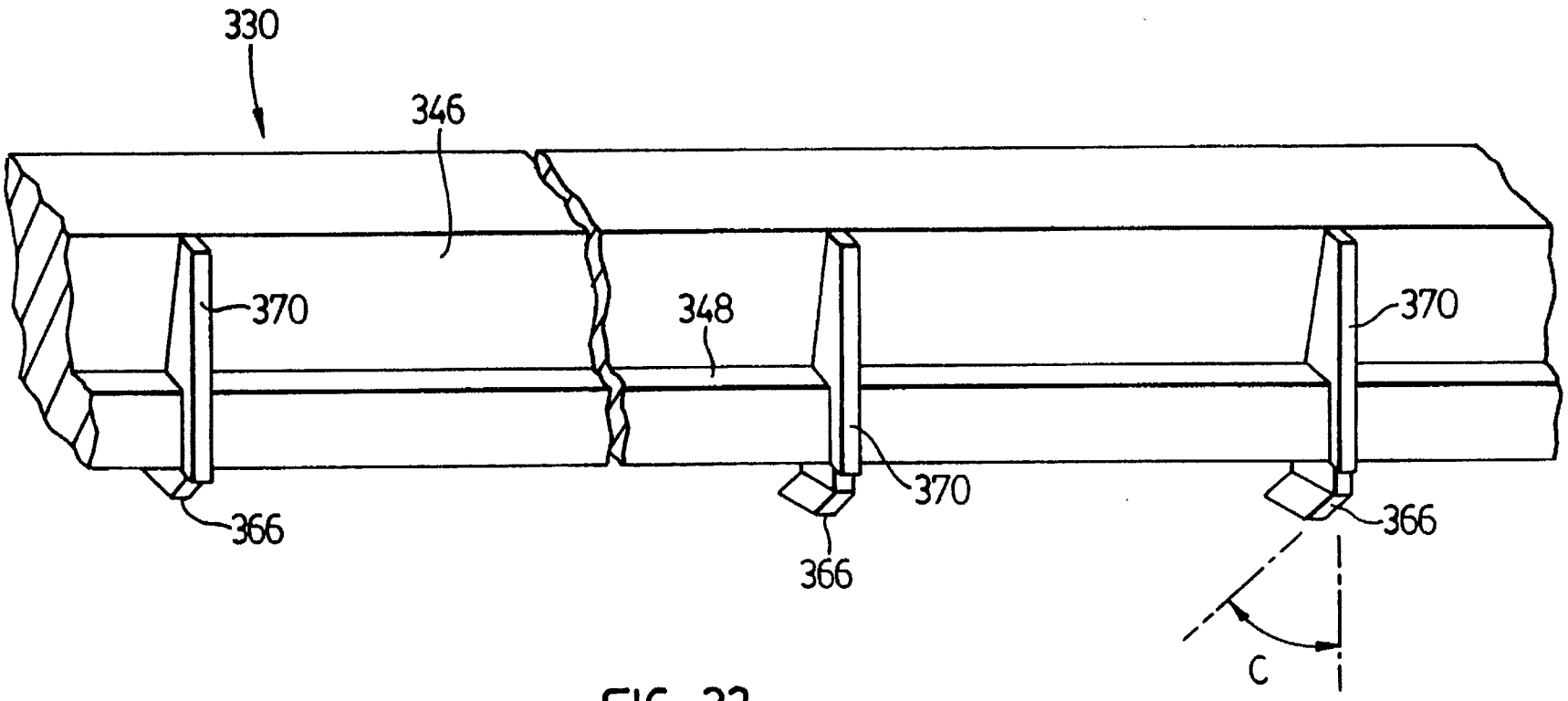
FIG. 32 is an elevational perspective view of a portion of the distribution divider of FIG. 24.

The divider 330 and side 342 define a tapered opening 362 which, as in the earlier embodiments has its smallest clearance near the inlet port 336 and which gradually increases to a maximum at the opposite end of the duct 316. For example, in a duct having a size of 30 mm (height) by 12 mm (width) and a length of 690 mm, good results have been achieved using a clearance which starts at 1.21 mm at the inlet port 336 and gradually increases by 0.008 mm every 25.0 mm between fins to 1.42 mm at the far end. However, unlike earlier embodiments of the divider where the wall portion of the divider extended close to the base of the duct to create an opening between the wall portion and base, the divider 330 omits such a wall portion and instead creates the opening 362 adjacent the side 344 of the duct 316 as shown in FIG. 31. The advantages of this configuration are discussed further below.

The opening 362 is punctuated by dividing walls 370 and by fins 366 which are integral with the dividing walls. Each fin 366 extends downwardly from the divider 330 into the inlet portion 332 and across the opening 362 to a respective slot 361 (shown in FIG. 30 and in ghost in FIG. 31). As in the earlier embodiments, each fin is inclined toward the inlet port 336 to help redirect air from the inlet portion 332 through the opening 362. Good results have been achieved using an angle "C" (see FIG. 32) of about 45°.

In this embodiment the fins are evenly spaced. In the 30 mm by 12 mm duct, good results have been obtained using a 25 mm spacing. The width of each fin (i.e. measured from the inside surface of side 342 in a left to right direction in FIG. 30) need not occupy the entire extent of the inlet portion to adequately redirect air into the opening 362. It appears that there is little appreciable difference between a fin which extends half way across the inlet portion 332 and one which extends beyond this point. Likewise, the fin should not be so narrow that it cannot redirect a desired volume of air. In the FIG. 30 embodiment, good results have been obtained using a width of about 3.0 mm. Generally, it has been found that fin size should vary with pressure, i.e. the fin should increase in size as the working pressure increases.

It has been found that the air pattern adjacent to the inlet 336 is complicated. Apart from the first two fins, the length of each fin (i.e. measured downwardly from the inside surface of the flow divider in FIG. 30) increases with increased distance from the inlet port 332. In the FIG. 30 embodiment, good results have been achieved where the fin closest to the inlet port 336 is 0.50 mm long, and the next fin has zero length. Then, each successive fin increases in length by 0.08 mm to a maximum length of 1.30 mm at the other end.

This principle of the second fin being shorter than the first, and then steadily increasing fin length for the third and subsequent fins can be applied to other embodiments.

An important advantage of this embodiment is its improvement in performance over the earlier embodiments. This configuration facilitates air flow through the distribution system 310 by eliminating one right angle turn in the air flow as compared to the earlier embodiments. Thus, the air flow in system 310 encounters less resistance (i.e. fewer obstructions) than, say, the system 210. To illustrate, air flow moving through the inlet portion 232 in system 210 is redirected by about 90° into the opening 262 of the distribution divider 230. Upon exiting the opening 262, the air flow encounters side 242 and is redirected through an angle of about 90° toward the outer port 238. In the system 310, on the other hand, air exiting the opening 362 is not bounced off of side 342 but proceeds in a generally straight path to the outlet port 338.

The system 310 also employs a coupler 380 similar to the couple 280 discussed above.

Figure 33:
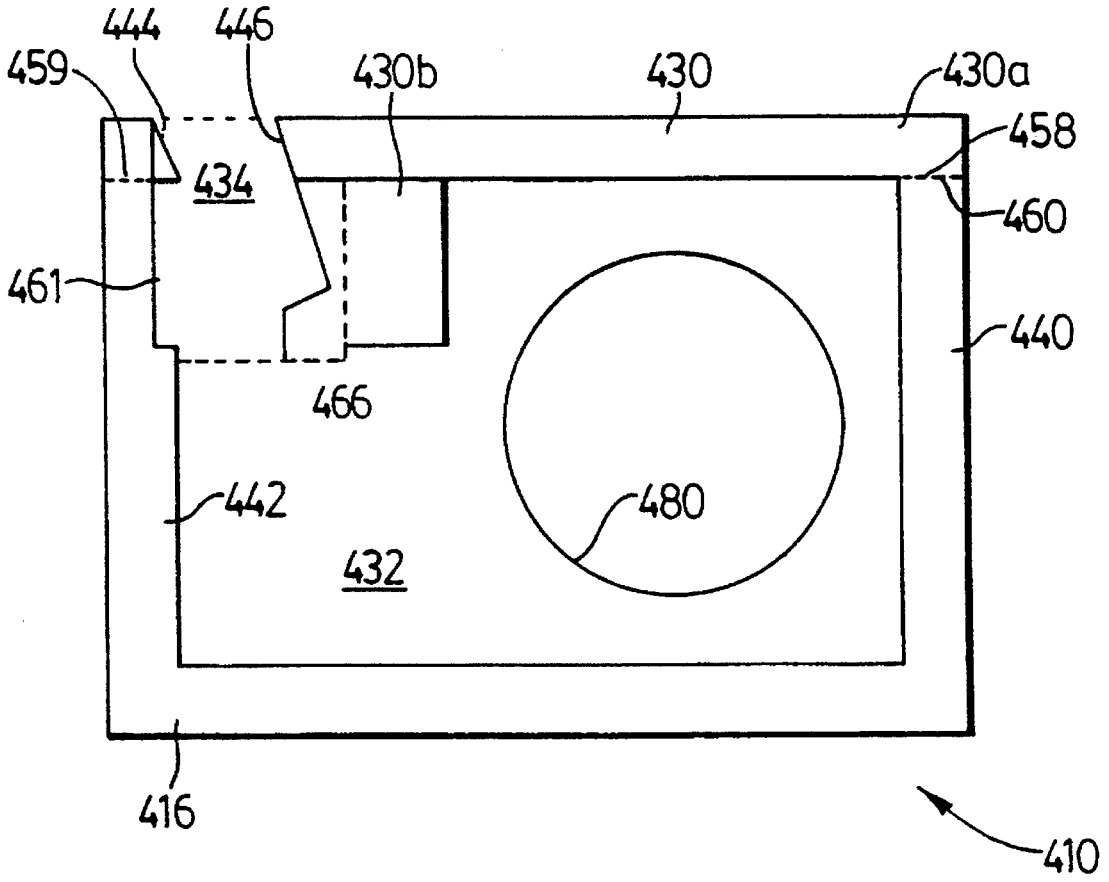
FIG. 33 is a sectional view of another embodiment of the air distribution system.

Reference will now be made to FIG. 33, which shows a sectional view of another embodiment of the distribution system of the present invention. For simplicity like reference numerals used in earlier figures are used, except here with the prefix "4". For brevity, again the description of similar components is not repeated, and the description above applies to FIG. 33 with allowance for the minor variations between the different embodiments.

Here, the overall air distribution system 410 has the air duct 416 and divider 430 dimensioned to provide a small diffuser for an HVAC (heating, ventilating and air conditioning) system, more particularly as detailed below it is dimensioned for fitting with 2 ft× 4 ft ceiling tiles. The divider 430 comprises a top member or wall **430*a*, and the actual divider 430*b***, which is a separate element secured at either end.

The divider 430 defines seats 458,459. Additionally, the wall 442 defines the slots 461 for receiving the fins and their seats 459. The side 440 defines a respective seat 460.

The fins 466 extend down below the main body of the floor divider 430 is shown. Here, the overall outside dimension of the duct is 4" (101.7 mm)×2 ¼" (70 mm), for corresponding internal dimensions 56 mm×84.5 mm. The inlet 480 has an internal diameter of 32 mm.

The fin slots 461 have a depth of 19.1 mm. The dimension B of the divider 430 is also 19.1 mm.

Unlike earlier embodiments, there is not such a pronounced division between the inlet and outlet portions 432, 434; rather, there is a narrow throat between them. Further, the side walls 444, 446 diverge slightly away from one another. As shown, the side walls 444, 446 can have respective angles of approximately 22° and 19° to the vertical. The dimension C at the outlet can be 13 mm.

Thus, it will be apparent that the present invention provides a simple yet effective air distribution system.

It will be clear to those skilled in the art that the above description is merely exemplary, and that various modifications and improvements may be made to the present invention without departing from the scope of the invention. For example, in the FIG. 26 embodiment of the distribution divider 330, the outside surface can be shaped or bevelled as indicated by dotted line 375, to suit particular needs, such as to mount flush with a dashboard or window sill.

I claim:

1. An air distribution outlet comprising:

an elongate air duct;

a distribution divider for dividing the duct longitudinally to define inlet and outlet portions;

the duct defining an inlet port at one end of the inlet portion for communication with an air source and an outlet port in the outlet portion extending longitudinally of the duct;

the distribution divider defining a communication passage extending longitudinally of the duct for air communication between the inlet and the outlet portions, the passage increasing in width with increasing distance from said inlet port; and a plurality of fins located on the distribution divider extending across the air communication passage and extending into the inlet portion, the fins increasing in length with increasing distance from the inlet port;

whereby air entering the inlet port is distributed by the distribution divider substantially evenly to the outlet port.

2. The air distribution outlet of claim 1 wherein the inlet portion provides a substantially unobstructed passage for air communication between the inlet port and the distribution divider.

3. The air distribution outlet of claim 2 wherein the fins are generally evenly spaced along the length of the distribution divider.

4. The air distribution outlet of claim 1, 2, or 3 wherein air flow through the communication passage is generally aligned with air flow through the outlet portion.

5. The air distribution outlet of claim 1, 2, or 3 wherein air flow through the communication passage is offset less than 90° with air flow through the outlet port.

6. The air distribution outlet of claim 5 wherein said offset is less than 20°.

7. The air distribution outlet of claim 2 wherein the fins are inclined toward the inlet port.

8. The air distribution outlet of claim 7 wherein the fins form an acute angle of about 45° with the distribution divider.

9. The air distribution outlet of claim 7 wherein the duct comprises a generally elongate channel having a base and upstanding sides, and the inclination of each of said fins lies in a plane generally parallel to at least one of said sides.

10. The air distribution outlet of claim 1 or 3 wherein the length of adjacent fins differs by about 0.001 in. (0.02 mm).

11. The air distribution outlet of claim 2, wherein the distribution divider includes dividing walls, each being integral with a respective fin, the dividing walls dividing the outlet portion into discrete sections preventing cross-flow between adjacent sections.

12. The air distribution outlet of claim 11, wherein the outlet port is a generally elongated slot of substantially uniform width.

13. The air distribution outlet of claim 12, wherein the outlet port is provided in a generally planar upper surface of the distribution outlet, and the outlet slot is inclined at an angle thereto.

14. The air distribution outlet of claim 11 or 12, wherein the fins are inclined towards the inlet port.

15. The air distribution outlet of claim 1 or 3, wherein the first fin adjacent the inlet part has a first length, a second fin, adjacent the first fin, has a second length less than the first length, and the remaining fins located beyond the second fin are longer than the second fin and increase in length with increasing distance from the inlet port.

16. The air distribution outlet of claim 2 in combination with an opening window wherein said air duct includes a valve means adapted to interrupt said communication of air to the inlet port on opening of said window and to permit said communication of air to the inlet port on closing of said window.

17. The air distribution outlet of claim 12 further including a coupler for directing air flow from an air supply duct which communicates with said air source to said inlet port, the coupler being adapted to prevent direct air communication between the air source and the outlet portion.

18. The air distribution outlet of claim 17 wherein said air supply duct is generally circular and said air duct is generally rectangular, one end on the coupler being adapted to fit said supply duct and the other end of the coupler being adapted to fit the air duct, and a portion of the cross-section of the coupler being blocked to prevent said direct air communication to the outlet portion.

19. The air distribution outlet of claim 2, wherein air flow through the communication passage is substantially aligned with air flow through the outlet portion, and wherein the outlet portion is wider than the communication passage.

20. The air distribution outlet of claim 19, wherein the flow through the outlet portion is at an angle in the range of 10°–20° with air flow through the communication passage.

21. The air distribution outlet of claim 19, wherein the inlet portion is generally rectangular, and wherein the communication passage opens into one corner of the inlet portion.

22. The air distribution outlet as claimed in claim 21, wherein the fins extend from the corner laterally and downwardly into the inlet portion.

23. An air distribution outlet comprising:

an elongate air duct comprising a generally elongate channel having a base and upstanding sides;

a distribution divider dividing the duct longitudinally to define inlet and outlet portions;

the duct defining an inlet port at one end of the inlet portion for communication with an air source and an outlet port in the outlet portion extending longitudinally of the duct;

the distribution divider defining a communication passage extending longitudinally of the duct between the distribution divider and one of said sides, for air communication between the inlet and outlet portions, the passage increasing in width with increasing distance from said inlet port; and a plurality of fins located on the distribution divider and extending into the inlet portion, the fins increasing in length with increasing distance from the inlet port;

whereby air entering the inlet port is distributed by the distribution divider substantially evenly to the outlet port.

24. The air distribution outlet as claimed in claim 23, wherein air flow through the communication passage is generally aligned with the air flow through the outlet portion.

25. The air distribution outlet as claimed in claim 24, wherein the fins are inclined towards the inlet port.

* * * * *